United States Patent [19]

Biblarz et al.

[11] Patent Number: 4,939,417

[45] Date of Patent: Jul. 3, 1990

[54] HIGH PRESSURE DISCHARGE LAMP WITH INCANDESCENT FILAMENT FOR STARTING

[75] Inventors: Oscar Biblarz, Swampscott, Mass.; Joseph D. Michael, University Hgts., Ohio; Paul Thibault, Danvers, Mass.

[73] Assignee: GTE Products Corporation, Danvers, Mass.

[21] Appl. No.: 287,311

[22] Filed: Dec. 20, 1988

[51] Int. Cl.[5] ..... H01J 61/54

[52] U.S. Cl. ..... 313/595; 313/596; 313/8

[58] Field of Search ..... 313/595, 596, 291, 8

[56] References Cited

U.S. PATENT DOCUMENTS 1,006,333 10/1911 Wood ..... 313/595 X 2,094,848 10/1937 Roberts ..... 313/595 X

FOREIGN PATENT DOCUMENTS 2424294 12/1974 Fed. Rep. of Germany ..... 313/596

*Primary Examiner*—Kenneth Wieder

*Attorney, Agent, or Firm*—Joseph S. Romanow

[57] ABSTRACT

A high pressure sodium arc tube assembly includes a light-transmitting arc tube containing a fill material including sodium and mercury, a pair of electrodes sealed in opposite ends of the arc tube, and a filament or other resisitive member located within the arc tube and extending between opposite ends thereof. The filament is electrically connected to the electrodes. The filament provides a sufficient electric field and an abundance of electrons dispersed throughout the discharge region to initiate an arc discharge when the electrodes are energized. The filament is selected to produce an electric field in the discharge region prior to initiation of arc discharge of at least 20 volts per centimeter. After an arc discharge is initiated, the voltage between the electrodes drops, and the filament is partially short-circuited by the arc discharge. The filament provides fast initial starting and fast hot restarting, while eliminating the requirement for high voltage starting pulses.

16 Claims, 2 Drawing Sheets

HIGH PRESSURE DISCHARGE LAMP WITH INCANDESCENT FILAMENT FOR STARTING

FIELD OF THE INVENTION

This invention relates to high pressure arc discharge lamps and, more particularly, to high pressure sodium lamps which utilize an incandescent filament located within the arc tube for starting.

BACKGROUND OF THE INVENTION

The standard high pressure sodium (HPS) arc discharge lamp is a very efficient source of visible light and has the highest efficacies (lumens per watt) of any commercially available lamp. However, the HPS lamp has found only limited application, due in part to the special starting and ballasting requirements. A high voltage pulse on the order of 2000 volts is required for cold starting of prior art HPS lamps. Voltages as high as 10 kilovolts are required for hot restart. Typically, there is a delay of several minutes before a hot HPS lamp can be restarted at 2000 volts. For outdoor lighting and for some industrial applications in developed countries, the starting and ballasting requirements do not deter use. For other applications and particularly in underdeveloped countries, there is a reluctance to replace incandescent lamps with the more efficient HPS lamps. In order to gain more widespread acceptance, it is desirable to simplify the starting and ballasting requirements of HPS lamps. New starting techniques should provide fast starts and restarts, as well as simplicity and low cost.

An incandescent lamp utilizing a gaseous fill that is enriched with metallic vapors is disclosed in French Publication No. 2,346,852, dated Oct. 28, 1977. Although the French publication suggests a fill material including sodium, the disclosed lamp operates as a gas-enhanced incandescent lamp and not as an arc discharge lamp. A high pressure sodium lamp utilizing a tungsten ignition wire within the discharge tube is shown by de Groot et al in *The High Pressure Sodium Lamp*. Philips Technical Library, 1986, page 184. The tungsten ignition wire is connected to only one of the two electrodes in the discharge tube and operates by reducing the gap in which initial breakdown occurs. A high pressure sodium discharge lamp having a multiple turn tungsten wire starting aid wound around the outside of the arc tube is disclosed in U.S. Pat. No. 4,037,129 issued July 19, 1977 to Zack et al. During starting, the tungsten starting aid is connected to the same voltage as one of the arc tube electrodes.

It is a general object of the present invention to provide high pressure arc discharge lamps having improved electrical characteristics, not necessarily improved light output.

It is another object of the present to provide high pressure arc discharge lamps that can be started without high voltage starting pulses.

It is another object of the present invention to provide high pressure sodium arc discharge lamps that can be started with voltages that do not exceed the available AC supply voltage.

It is a further object of the present invention to provide high pressure sodium arc discharge lamps that have fast starting and fast hot restarting characteristics.

It is yet another object of the present invention to provide high pressure sodium arc discharge systems which are simple in construction and low in cost.

SUMMARY OF THE INVENTION

According to the present invention, these and other objects and advantages are achieved in an arc tube assembly comprising a light-transmitting arc tube that encloses a discharge region and contains a fill material for supporting an arc discharge, a pair of electrodes sealed in the arc tube, and a filament located within the arc tube and extending between opposite ends thereof. The filament is electrically connected to the electrodes. The filament provides sufficent electric field and an abundance of electrons dispersed throughout the discharge region to initiate an arc discharge therein when the electrodes are energized. The arc tube is typically a high pressure sodium arc tube.

Preferably, the filament is designed to produce an electric field in the discharge region prior to initiation of arc discharge of at least 20 volts per centimeter. The filament simultaneously produces a well-distributed electric field, thermonic electrons and heating which are sufficient to rapidly inititate an arc discharge within the arc tube. Preferably, the filament is a refractory metal such as tungsten. After an arc discharge is inititated, the voltage between the electrodes drops, and the filament is partially short-circuited by the arc discharge. The filament provides fast initial starting and fast hot restarting, while eliminating the requirement for high voltage starting pulses. In addition, the filament provides light during the interval between application of electrical power and initiation of an arc discharge.

According to another aspect of the invention, an arc tube assembly comprises a light-transmitting arc tube that encloses a discharge region and contains a fill material for supporting an arc discharge, a pair of electrodes sealed at opposite ends of the arc tube, and a resistive member located within the arc tube and extending between opposite ends thereof. The resistive member is electrically connected to the electrodes and provides sufficient electric field and electrons in the discharge region to initiate an arc discharge when the electrodes are energized. The resistive member can be a filament extending between the electrodes without touching the wall of the arc tube. Alternatively, the resistive member can be one or more resistive strips located on the inside surface of the arc tube, or can be a transparent coating on the inside surface of the arc tube.

BRIEF DESCRIPTION OF DRAWINGS

For a better understanding of the present invention, together with other and further objects, advantages, and capabilities thereof, reference is made to the accompanying drawings which are incorporated herein by references and in which.

DETAILED DESCRIPTION OF THE INVENTION

Figure 1:
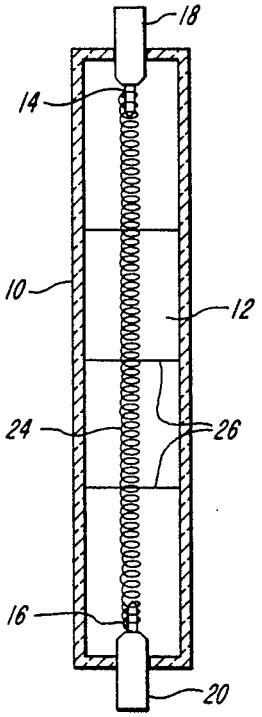
FIG. 1 is a cross-sectional view of a high pressure sodium arc tube assembly in accordance with the present invention.

A high pressure sodium arc tube assembly in accordance with the present invention is shown in FIG. 1. The assembly includes a light-transmitting ceramic arc tube 10, usually made of polycrystalline alumina. The arc tube 10 is a cylindrical shell that is closed on both ends to define a sealed discharge region 12. Electrodes 14 and 16 are positioned at opposite ends of arc tube 10 and are mounted on electrode feedthroughs 18 and 20, respectively. The feedthroughs 18 and 20 are typically niobium tubes which are sealed to the arc tube 10 and which provide means for energizing electrodes 14 and 16 from an external electrical source. The fill material inside arc tube 10 typically includes xenon gas plus mercury and sodium in the form of an amalgam.

The arc tube assembly of FIG. 1 is typically incorporated into a conventional high pressure sodium lamp including a transparent outer envelope, a lamp base for mounting and for connection to an electrical source, mechanical means for mounting the arc tube in the outer envelope, and means for electrically connecting the electrodes 14 and 16 to the lamp base.

In accordance with the invention, a filament 24 is positioned within the arc tube 10 and is connected at opposite ends to electrodes 14 and 16. The filament 24 thus extends the length of the arc tube 10 and, in the embodiment of FIG. 1, is located approximately on the axis of arc tube 10. The filament 24 can be maintained in position and prevented from contacting the arc tube wall by one or more filament spacers 26 and by proper recrystallization of the tungsten.

In a preferred embodiment, the filament 24 is a double-coiled or a triple-coiled tungsten wire. More generally, the filament 24 is any refractory material that can produce the required electric field as described hereinafter. Suitable materials in addition to tungsten include refractory metals such as tantalum, rhenium, molybdenum, and conductive ceramics.

The filament 24 is electrically connected to electrodes 14 and 16. When a voltage is applied to the arc tube 10 between electrodes 14 and 16, the filament 24 lights up as an incandescent lamp. The filament 24 has three important effects which result in rapid formation of an arc discharge within the arc tube 10. The voltage applied across the filament 24 produces an electric field in the discharge region 12. As described hereinafter, the filament 24 parameters and the magnitude of the applied voltage should be selected to produce an axial electric field in the discharge region 12 of at least 20 volts per centimeter. The filament 24 also emits thermionic electrons which assist in the formation of an arc discharge. Finally, the heat released from the filament 24 warms the sodium amalgam in the arc tube 10 and rapidly causes the sodium/mercury to attain a high enough vapor pressure to form the desired arc discharge.

When an arc discharge forms, the voltage between the electrodes 14 and 16 drops, causing a reduction in current through the filament 24. The sodium quickly overtakes the discharge because of its lower ionization potential compared to xenon and mercury, thus finishing the ignition process without the need for a high voltage starting pulse. In a hot lamp restart, the sodium is activated in just a few seconds. The required voltage across the filament 24 to effect starting is no greater than normal AC line voltage. For example, the lamp shown in FIG. 1 can be started with an applied voltage below 120 volts AC. After initiation of a discharge, the voltage typically drops to about 60 volts. Thus, the requirement for a high voltage starting pulse generator is eliminated. Typically, the filament is designed for a starting voltage that is about twice the arc running voltage. The arc tube assembly of the present invention can be stabilized by a standard capacitive or inductive ballast.

The typical tungsten filament must be light bulb grade tungsten capable of handling the starting current. Since the filament is not carrying substantial current except during startup, it is expected that the filament will last considerably longer than the filaments in incandescent light bulbs. The filament is designed to provide sufficient electric field along the axis of the arc tube 10 to ignite the sodium in the tube by acceleration of thermionic electrons. The ignition of mercury is not required. Xenon ignition can often precede ignition of sodium if the voltage is high enough and/or if the fill pressure is low enough. However, in the arc tube assembly of the present invention, ignition of xenon is not necessary for heating of the sodium, since the sodium is heated by the filament. The required electric field has been found experimentally to be between 20 volts per centimeter and 30 volts per centimeter to ignite the vapors thermionically. The filament, which is typically double-coiled, must develop the required electric field along the axial direction of the tube 10 as it becomes incandescent. For example, a filament carrying 1.0 amp with a hot resistance of 60 ohms develops 60 volts. If the length of the filament is between 2 and 3 centimeters, then the electric field is between 20 and 30 volts per centimeter, and a discharge will be initiated. It will be understood that different combinations of voltages, filament resistances and filament lengths can be used to provide the required electric field.

Figure 2:
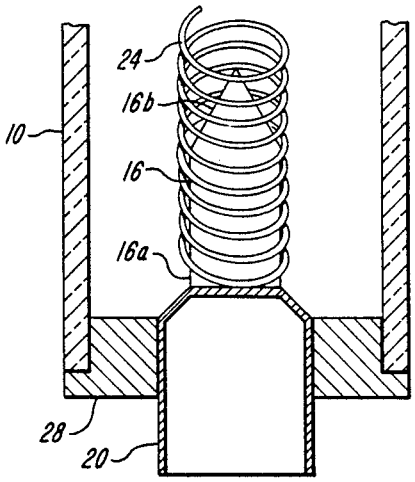
FIG. 2 is an enlarged, partial cross-sectional view of one end of the arc tube of FIG. 1.

An enlarged view of one end of the arc tube assembly of FIG. 1 is shown in FIG. 2. As indicated above, the electrode feedthrough 20 is typically a niobium tube. The electrode 16 is typically tungsten. In a preferred embodiment, the electrode 16 includes a cylindrical portion **16*a* attached to feedthrough 20 and a tapered portion 16*b*. The portion 16*b* tapers from the diameter of cylindrical portion 16*a* to a point and has a generally conical shape. The filament 24 is attached to the cylindrical portion 16*a*** by crimping or an equivalent mechanical technique.

In a preferred embodiment as shown in FIG. 2, the arc tube 10 is sealed with a polycrystalline alumina hat seal 28 through which the electrodes are inserted. A conventional frit seals the hat seal 28 to the arc tube 10 and to the feedthrough 20. In the preferred example, the electrode feedthrough 20 is made of niobium tubing 0.123-inch in diameter, and the tungsten electrode 16 has a diameter of 0.045-inch. The filament is either attached directly to the electrode 16 by twisting or crimping, or it can be attached indirectly through an intermediate tungsten wire.

Figure 4:
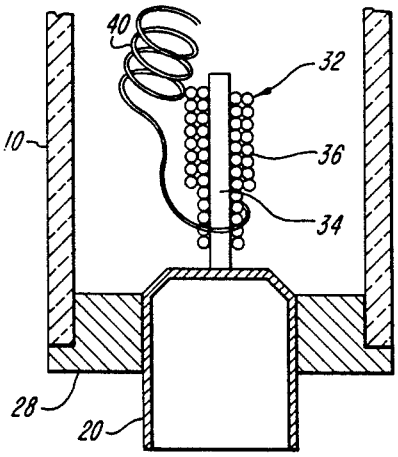
FIG. 4 is an enlarged, partial cross-sectional view of one end of the arc tube of FIG. 3.
Figure 3:
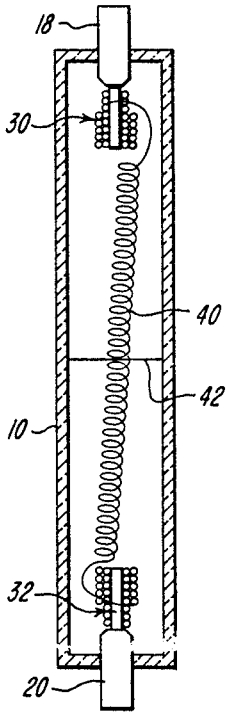
FIG. 3 is a cross sectional view of a high pressure sodium arc tube assembly in accordance with another embodiment of the invention.

An alternate embodiment of the arc tube assembly in accordance with the present invention is shown in FIG. 3. Elements that are common with the arc tube assembly of FIG.1 have the same reference numerals. The arc tube 10 has electrode feedthroughs 18 and 20 mounted in opposite ends thereof. Electrodes 30 and 32 are mounted to feedthroughs 18 and 20, respectively. The electrodes 30 and 32 are conventional backwound, coated tungsten HPS electrodes. As shown in FIG. 4, electrode 32 includes a tungsten rod 34 attached to feedthrough 20. Tungsten coils 36, with a typical coating consisting of barium carbonate, calcium carbonate and yttrium oxide, are wound around rod 34. Coatings on coil 36 are used to enhance electron emission independent of the sodium presence.

Referring again to FIG. 3, a filament 40 is located within arc tube 10 and extends between electrodes 30 and 32. Because the ends of electrodes 30 and 32 are enlarged, it is most practical to connect the ends of the filament 40 to each electrode near the point of intersection between the electrode rod and the respective feedthrough 20, as best shown in FIG. 4. This causes the filament 40 to be somewhat offset from the axis of the tube 10. Preferably, the filament 40 is connected to radially opposite sides of the respective electrodes 30 and 32 so that it runs at a small angle to the tube axis, as shown in FIG. 3. A spacer 42 prevents the center portion of the filament 40 from contacting the wall of the arc tube 10. The filament 40 can be constructed generally in the same manner as the filament 24 shown in FIG. 1 and described hereinabove.

Prior to ignition of an arc discharge in the discharge region, many electrons are emitted thermionically from the hot tungsten filament. Due to the presence of sodium in the arc tube, the tungsten filament is an efficient electron emitter. Electrons emitted by the filament are available before the discharge is initiated and are one reason that the breakdown occurs at such low voltages. After ignition, the ends of the tungsten filament act as the arc electrodes with an apparent Schottky effect enhancement at the cathode. Schottky effect enhancement does not occur in the case of the conventional HPS electrodes shown in FIGS. 3 and 4. This is advantageous because of the lower electrode voltage drop. The dependence of the discharge on sodium vapor density is a potential source of instability between the incandescent and the arc modes. If at ignition the arc heating depletes sodium from the ends of the filament where the current now concentrates, the arc will be starved of electrons and the lamp will return to its incandescent mode. When the ends are cool enough to redeposit sodium and thus reestablish the required supply of electrons, the arc will be reinitiated. The on/off cycling can continue if proper design precautions are not taken. It is important to thermally design the electrode ends of the arc so that an equilibrium point is established at which sufficient heating and sodium coating coexist on the surface for the required thermionic emission to be available. Furthermore, the ends of the arc tube must be thermally insulated so that the sodium supply is hot enough to maintain the surface coverage on the tungsten and the vapor density for the arc. Typically, conventional 10 millimeter heat shields with ceramic insulation on the arc tube ends are used.

Referring again to FIG. 2, the electrode 16 terminates in the shape of a cone. The cone is positioned in the region of the filament 24 so that it protrudes into the arc. The arc ends seek the axial location on the cone at which the heating and the thermionic electrons match. At this temperature and surface area, the arc footpoints are not starved of current and the surface conditions are stable. Stability is assured with the activator producing emitter cathode system shown in FIGS. 3 and 4.

Lamps have been constructed in accordance with the embodiments of FIGS. 1 and 3. The lamps with cone-shaped electrodes, as shown in FIGS. 1 and 2, exhibited practically instaneous hot restart. The fully-stabilized arc lamps provided 50 lumens per watt. Lamps having conventional HPS electrodes as shown in FIGS. 3 and 4 exhibited practically instanteous hot restart. The fully-stabilized arc lamps provided 60 lumens per watt. In both cases, arc ignition on cold start is too fast to measure without special instrumentation, and two to three minutes are required to fully stabilize the arc after cold start.

Figure 5:
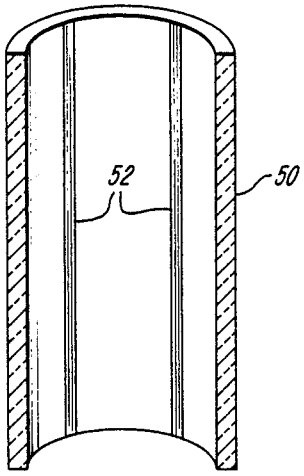
FIG. 5 is a cross-sectional view of an arc tube illustrating yet another embodiment of the invention wherein resistive strips are located on the arc tube wall.
Figure 6:
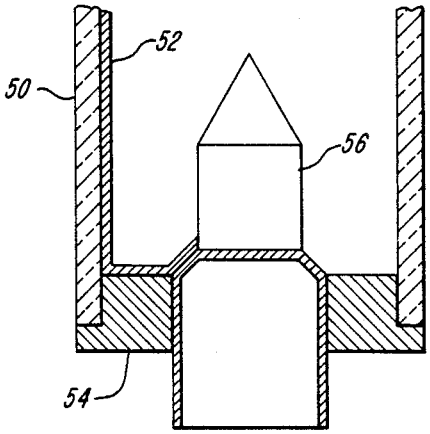
FIG. 6 is a partial cross-sectional view of an arc tube assembly utilizing resistive strips on the arc tube wall.

According to still another embodiment of the invention, the filament for initiating discharge is replaced with one or more resistive strips located on the inside surface of the polycrystalline alumina arc tube. A cross-sectional view of an arc tube 50 is shown in FIG. 5. One or more resistive strips 52 are applied to the inside surface of the arc tube and are connected to the electrodes at both ends of the arc tube. As shown in FIG. 6, the strips 52 extend across hat seal 54 and are attached to electrode 56. Preferably, several strips 52 are utilized at spaced-apart locations on the wall of arc tube 50.

The strips 52 perform the same function as the filaments 24 and 40 described hereinabove by developing an electric field within the arc tube and supplying thermionic electrons. The strips 52 must be narrow to minimize light blockage and must have a resistance selected to produce the required electric field of 20 volts per centimeter to 30 volts per centimeter when the specified starting voltage is applied to the electrodes. The material of the strips 52 must be compatible with the hot alumina and the discharge constituents. Refractory metals such as niobium and molybdenum, and conductive ceramics are suitable materials. Techniques such as plasma spraying, electroless plating and metallizing plating are suitable techniques for applying the strips 52 to the arc tube wall. According to a variation of the configuration shown in FIGS. 5 and 6, the entire inside surface of arc tube 50 is coated with a transparent material which provides the required starting function without substantially reducing the lumen output from the arc tube.

The present invention has been described thus far in connection with high pressure sodium lamps. It is well known that metal halide arc discharge lamps require high voltages or other starting devices to initiate discharge. The present invention can be utilized in metal halide lamps to effect starting. A filament or other resistive member having a resistance selected to produce the required electric field for starting is connected between the electrodes of the metal halide arc tube.

The arc tube assembly in accordance with the present invention provides numerous advantages over prior art arc tube configurations. The need for high voltage pulses to start high pressure sodium lamps is eliminated. The filament arc tube of the present invention permits the use of line voltages at available frequencies for lamp starting. Therefore, the hardware associated with high voltage starting can be eliminated, and there is no disturbance to the power line from the high voltage starting pulses. The elimination of high voltage starting transients is particularly important, for example, when a large number of street lights are started at once. The filament arc tube of the present invention provides faster cold starting and faster hot restarting than prior art HPS lamps. Furthermore, arc reignition is smoother than in conventional lamps. In addition, light is produced the moment power is applied. The incandescent filament lights up almost instantaneously when the arc is not on and goes out when the arc is on. The filament arc tube of the invention permits different xenon fill pressures than in prior art high pressure sodium lamps because xenon is not required to assist in starting.

While there has been shown and described what is at present considered the preferred embodiments of the present invention, it will be obvious to those skilled in the art that various changes and modifications may be made therein without departing from the scope of the invention as defined by the appended claims.

What is claimed is:

1. An arc tube assembly comprising:

a light-transmitting arc tube that encloses a discharge region and contains a fill material for supporting an arc discharge;

a pair of electrodes sealed in said arc tube;

a filament located within the arc tube and extending between opposite ends thereof, said filament being electrically connected to said electrodes and providing an electric field of at least 20 volts per centimeter in said discharge region prior to initiation of an arc discharge, said electric field being sufficient to initiate an arc discharge within said discharge region when said electrodes are energized.

2. An arc tube assembly as defined in claim 1 wherein said fill material includes sodium and mercury.

3. An arc tube assembly as defined in claim 2 wherein said filament comprises a refractory metal.

4. An arc tube assembly as defined in claim 2 wherein said filament comprises tungsten.

5. An arc tube assembly as defined in claim 4 wherein said tungsten filament is double-coiled to provide the required electric field.

6. An arc tube assembly as defined in claim 2 wherein an end portion of each electrode within said discharge region is tapered.

7. An arc tube assembly as defined in claim 2 wherein said filament comprises a tungsten incandescent filament.

8. An arc tube assembly as defined in claim 2 further including spacer means for spacing said filament from said arc tube.

9. An arc tube assembly as defined in claim 2 wherein said arc tube has a generally cylindrical shape and wherein said filament is aligned substantially parallel to the axis of said arc tube.

10. An arc tube assembly comprising:

a light-transmitting arc tube that encloses a discharge region and contains a fill material for supporting an arc discharge;

a pair of electrodes sealed in said arc tube;

a resistive member located within the arc tube and extending between opposite ends thereof, said resistive member being electrically connected to said electrodes and providing an electric field of at least 20 volts per centimeter in said discharge region prior to initiation of an arc discharge, said electric field being sufficient to initiate an arc discharge within said discharge region when said electrodes are energized.

11. An arc tube assembly as defined in claim 10 wherein said resistive member comprises at least one strip on an inside surface of said arc tube.

12. An arc tube assembly as defined in claim 11 wherein said at least one metal strip is a refractory metal selected from the group consisting of niobium and molybdenum.

13. An arc tube assembly as defined in claim 10 wherein said resistive member comprises a transparent coating on an inside surface of said arc tube.

14. An arc tube assembly as defined in claim 10 wherein said resistive member comprises a refractory metal.

15. An arc tube assembly as defined in claim 10 wherein said fill material includes sodium and mercury.

16. An arc tube assembly as defined in claim 10 wherein said fill material includes a metal halide.

* * * * *